United States Patent [19]

Suhr et al.

[11] Patent Number: 4,660,885

[45] Date of Patent: Apr. 28, 1987

[54] ADJUSTING MECHANISM FOR THE STEP-WISE LOCKING HEIGHT ADJUSTMENT OF BACKREST OF WORK CHAIR

[75] Inventors: Heinz-Peter Suhr, Grossbottwar; Bernd Weinberger, Steinheim, both of Fed. Rep. of Germany

[73] Assignee: Firma August Froscher GmbH & Co. K.G., Steinheim, Fed. Rep. of Germany

[21] Appl. No.: 890,767

[22] Filed: Jul. 25, 1986

[30] Foreign Application Priority Data

Aug. 2, 1985 [DE] Fed. Rep. of Germany ..... 3527783

[51] Int. Cl.[4] ..... A47C 7/46

[52] U.S. Cl. ..... 297/353; 248/429; 297/410

[58] Field of Search ..... 297/353, 410; 248/429; 312/336, 341 NR

[56] References Cited

U.S. PATENT DOCUMENTS 4,012,158 3/1977 Harper ..... 297/353 X 4,036,525 7/1977 Howk ..... 297/353

4,221,430 9/1980 Frobose ..... 297/353

4,516,811 5/1985 Akiyama et al. ..... 312/341 X

*Primary Examiner*—Kenneth Downey

*Assistant Examiner*—Peter R. Brown

*Attorney, Agent, or Firm*—Robert E. Burns; Emmanuel J. Lobato; Bruce L. Adams

[57] ABSTRACT

Adjusting mechanism for the step-wise height adjustment of the backrest of a work chair comprises two U-form guide bars embracing side edges of a rectangular support arm extending up from the seat of the chair. A C-form slide, on which the backrest is mounted, embraces and is slidable on the guide bars. One of the guide bars has a wider flange in which locking recess are formed. A locking lever pivotally mounted on the slide has a nose portion engageable in the locking recesses to hold the slide and hence the backrest in selected fixed position. The locking lever is spring biased to locking position and is releasable by a handle at the side of the slide so that the locking lever can be released and the slide, with the backrest, moved up or down with one hand.

10 Claims, 2 Drawing Figures

ADJUSTING MECHANISM FOR THE STEP-WISE LOCKING HEIGHT ADJUSTMENT OF BACKREST OF WORK CHAIR

FIELD OF INVENTION

The invention relates to adjusting mechanism for the step-wise locking height adjustment of the backrest of a work chair with an essentially vertical support arm on which a sliding guide element connected fast with the backrest is slidably arranged and wherein the locking means has a locking element, actuatable against spring force which engages in locking recesses.

BACKGROUND OF INVENTION

Height adjustment mechanisms for the backrest of work chairs are known in many forms. It follows that the parts on which the spinal column of the user is supported in sitting and/or leaning back can easily be adjusted to a height position relative to the seat satisfying the requirement of the individual user. Such support and adjusting mechanisms must naturally support and transmit the forces which are to be transmitted from the backrest to the support arm and thereby to the chair frame and indeed also when the backrest is obliquely loaded. On account of this height adjustment, a single support arm is as a rule selected. Thereby torsional forces must also be supported. It is important that such height adjustment is easy to actuate and does not become jammed even after a long time so that one can, if possible, free the arresting mechanism and with the same hand effect the height adjustment. With most known mechanisms that is not possible. Height adjustment mechanisms provided with a screw have the advantage that step-less adjustment can be made; however, they require actuation with both hands. Adequate fine-step height adjustment can also be created which serves the practical need. In order suitably to support the forces, relatively long guides are necessary. These are inclined to stick.

SUMMARY OF THE INVENTION

The invention is directed to the problem of providing an easily and safely usable adjusting mechanism for the height adjustment of the backrest of a work chair which is composed of simple parts, is reliable in its operation and favorably supports the applied forces.

In accordance with the invention, it is provided that the sliding guide element is formed as a C-form elongate profile part which is slidable on substantially U-form guide bars which in turn are secured on the support arm whereby the flank of one of the guide bars has locking recesses in which the locking nose of the locking lever pivotally mounted on the C-form sliding guide elements engages upon height-adjustment in variable height positions, An elongate C-form profile part as the sliding guide element allows the favorable support of forces in all directions. The U-form guide bars installed therein can production-wise be favorably formed so that easy movement is possible even after a long time and that the support arm proper does not need to be specially machined in the sliding zone. The locking mechanism assures secured holding of the backrest in the desired height position. The parts are easily made and easily installed.

Advantageously the U-formed guide bars and/or the C-form sliding guide element consist of extruded aluminum profile parts. These are easily and economically produced requiring no subsequent machining and provide favorable sliding conditions. The sliding conditions can be improved when the U-form guide bars have narrow guiding webs engaging the inner surfaces of the C-form sliding guide element between which there are formed grooves or depressions. There are thereby created, defined relatively narrow slide surfaces which are not inclined to lock even with long guide bars.

The locking recesses can be provided in different positions of the locking mechanism. Advantageously one of the flanks of the U-form guide bar is made longer than the other and locking notches or recesses are formed in the longer flank parts. Thus, like profile parts with suitable narrow guide webs can be produced for both sides of the support arm and suitable locking recesses can be provided in a flank of one of the guide bars.

The locking mechanism and the locking lever can be formed in different ways. Especially advantageous is that the locking lever pivotally mounted on the C-form sliding guide element is provided with a locking nose engageable with locking recesses of one of the U-form guide bars and is bent below the end of the sliding guide element to provide an actuating element with a handle outside the sliding guide element. Thus, the locking lever can easily and inexpensively be formed as a die-stamped sheet metal part. The actuating element can advantageously be biased to locking position by a compression spring between the actuating handle and the adjacent outer wall of the C-form sliding guide element. Such construction is simple, easily assembled and reliable in its operation.

BRIEF DESCRIPTION OF DRAWINGS

Futher details, developments, advantages and characteristics of the invention will be understood from the following description of a preferred embodiment shown by way of example in the accompanying drawings in which.

DESCRIPTION OF PREFERRED EMBODIMENT

Figure 2:
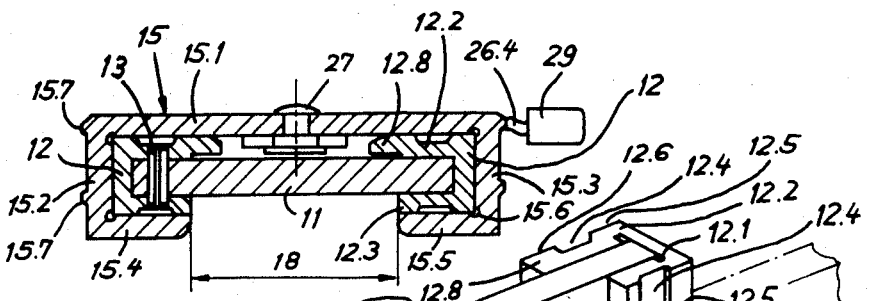
FIG. 2 is a horizontal cross section taken approximately on the line 2—2 of FIG. 1.

The adjusting mechanism 10 is mounted on the support arm 11 for the backrest of a work chair. The support arm 11 is, for example, a flat iron part of rectangular cross section which extends up approximately vertically behind the seat surface and is mounted on the chair frame. On opposite side edges 11.1 and 11.2 of the support bar 11 U-form guide bars 12 are secured by means of notched pins 13. The C-form sliding guide element 15 of which the profile is seen in FIG. 2 is slidable on the U-form guide bars. A schematically indicated cross bar 17 secured, for example by means of screws 16 on an upper portion of the C-form guiding element 15. The backrest of the chair is mounted in suitable manner on the cross bar 17.

The C-form sliding guide element 15 is an aluminum extruded profile part with a web 15.1 of which the length corresponds to the outer spacing of the guide bars 12. At ends of the web 15.1 there are joined integral flanks 15.2 and 15.3 on which, spaced from the web 15.1, there are C-flanks 15.4 and 15.5. All of the inner surfaces are smooth and uninterrupted. The corners 15.6 are formed somewhat deepened so that no binding can occur. Ribs 15.7 are formed on the inner surfaces of the flanks 15.2 and 15.3. Between inner edges of the opposite C-flanks there is provided a free space 18 which is seen in FIG. 2.

The U-form guide bars 12 are of like profile and are likewise formed as aluminum extruded parts. They have a receiving space 20 bounded by three plane surfaces perpendicular to one another by means of which they fit snugly on opposite side edges 11.1 and 11.2 of the support 11. Also, their corners 12.1 are inwardly deepened in order to avoid locking in mounting.

The outer side surfaces 12.7 of the U-form guide bars 12 are formed plane and uninterrupted and lie smoothly on the like-wise plane inner surfaces of the flanks 15.2 and 15.3 of the C-form sliding guide elements 15, fitting with light, sliding tolerance.

The flanks 12.2 and 12.3 of the U-form guide bars 12 spaced from one another by the thickness of the support arm 11 have grooves or depressions 12.4 which form narrow guide webs 12.5 and 12.6 spaced from one another so that they provide definite bearing surfaces for long lasting and low friction guiding and support of the forces applied to the backrest.

Figure 1:
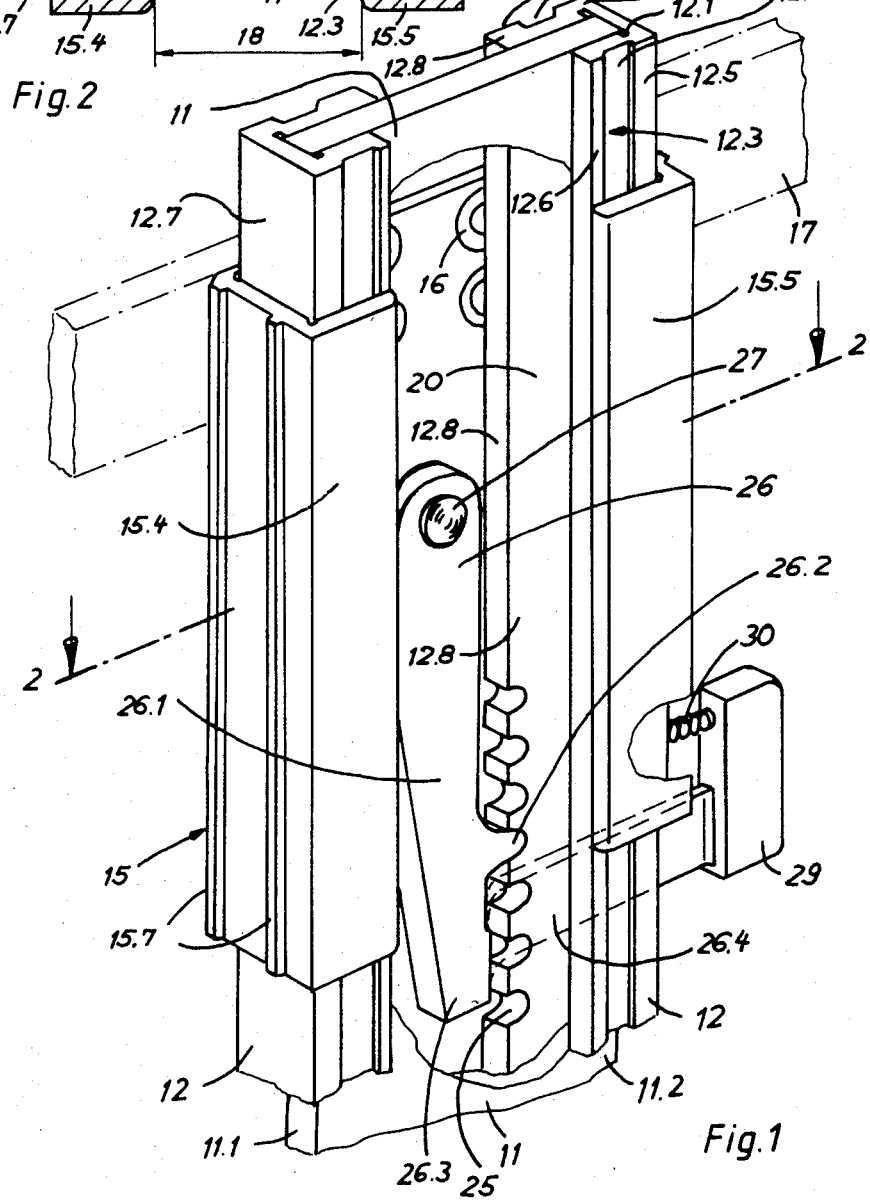
FIG. 1 is a partially broken away perspective view of adjusting mechanism in accordance with the invention.

The flanks 12.2 of the U-form guide bars 12 lying on the web 15.1 of the C-form sliding guide element 15 are formed longer than the other flanks 12.3 of the U-form guide bar 12 in order to form outwardly off-set extensions 12.8. The difference in the length of the flanks can be seen in FIG. 2. In the lower zone of the right hand flank 12.2 as seen in FIG. 1 there are formed half round locking recesses 25 suitably spaced from one another and over a length permitting the desired height adjustment of the backrest. The extension of the flank 12.2 over the opposite flank 12.3 permits access of suitable tools for stamping out or otherwise forming the locking recesses 25.

A locking lever 26 is pivotally mounted by means of a pivot pin 27 on the vertical center line of the web 15.1 of the C-form sliding guide element 15, somewhat above the middle. The locking lever 26 has a downwardly extending arm 26.1 on which there is a provided a locking nose 26.2 in the form corresponding to the locking recesses 25 so that it can engage in one or another of the locking recesses as illustrated in FIG. 1.

On the lower end 26.3 of the locking lever 26, there is provided a laterally extending actuating arm 26.4 which is offset from the plane of the locking lever 26 in order to pass outside the U-form guide bar 12. It extends beyond the outer side wall of the C-form sliding guide element 15 and is provided at its outer end with a handle 29. This extends somewhat upwardly in the region of the C-form sliding guide element 15. Between an upper end portion of the handle 29 and the adjacent outer wall of the C-form sliding guide element 15, there is a compression spring against which the handle can be pressed inwardly so that the locking lever is swung about its pivot in a clockwise direction as viewed in FIG. 1 so to disengage the locking nose 26.2 from the respective locking recess 25. When this is done, one can with the same hand with which the handle 29 is pressed move the entire sliding guide element 15 upwardly or downwardly, thereby adjusting the backrest to the corresponding desired height position. When the handle 29 is released, the spring 30 swings the locking lever in a counter-clockwise direction as viewed in FIG. 1 so as to bring the locking nose 26.2 back into one of the locking recesses 25.

It will thus be seen that with a few easily producible parts, there is provided an adjusting mechanism for the step-wise lockable height adjustment of the backrest of a work chair which can be easily actuated with one hand with no great exertion and, inspite thereof, provides for favorable support of forces applied to the backrest and a secure locking of the backrest in desired height-adjusted position.

In summary, the invention can be desired as follows:

Adjusting mechanism (10) for the step-wise height adjustment of the backrest of a work chair with a vertical support arm (11) has affixed on opposite side edges of the support arm U-form guide bars (12) on which a C-form elongate profile part (15) is vertically slidable. In a lengthened flank (12.2, 12.8) of one of the guide bars, there are formed locking recesses (25) in which the locking nose (26.2) of a locking lever (26) pivotally mounted on the sliding guide element (15) is engageable. The locking lever 26 is swingable to unlocked position against the force of a compression spring (30) by means of a handle (29). In unlocked position of the locking lever, the sliding guide element (15) with the back rest can be moved up or down with the same hand to the desired height position.

What I claim is:

1. Adjusting mechanism for lockable step-wise height adjustment of the backrest of a work chair having an approximately vertical support arm on which the backrest is mounted, said mechanism comprising a pair of elongate guide bars extending along and affixed to said support arm, one of said guide bars having therein a series of locking recesses, a slide embracing said support arm and guide bars and providing a support for said backrest, said slide being slidable along and guided by said guide bars in a direction lengthwise of said support arm, a locking lever pivotally mounted on said slide and having a nose engageable in said locking recesses of said one guide bar, said locking lever being movable between a locked position in which said nose of said locking lever is engaged in one of said recesses to thereby prevent movement of said slide and an unlocked position in which said nose is free of said recesses, means biasing said locking lever to locked position and manually operable releasing means external of said slide for moving said locking lever against said bias to unlocked position.

2. Adjusting mechanism according to claim 1, in which said support arm is of rectangular cross section and in which said guide bars embrace opposite side edges of said support arm, said guide bars being of U-form with a web connecting opposite flange portions, one of said flange portions being wider than the opposite flange portion and said locking recesses being in said wider flange portion.

3. Adjusting mechanism according to claim 2, in which said slide is of C-form with flange portions embracing said guide bars and a web portion connecting said flange portions, said locking lever being pivotally mounted on said web portion of said slide.

4. Adjusting mechanism according to claim 3 in which said manually operable releasing means comprises an arm projecting laterally from a lower end portion of said lever and extending beyond a side of said slide and a hangle on an outer end of said arm.

5. Adjusting mechanism according to claim 4, in which said means biasing said lever to locked position comprises a compression spring acting between said handle and a side of said slide.

6. Adjusting mechanism according to claim 1, in which said support arm is of rectangular cross section, said guide bars are of U-form cross section and embrace side edges of said support arm and said slide is of C-form cross section with flange portions embracing said guide bars and a web portion connecting said flange portions.

7. Adjusting mechanism according to claim 6, in which said guide bars and slide are extruded aluminum profiles.

8. Adjusting mechanisms according to claim 6 in which longitudinally extending grooves in outer surfaces of said guide bars divide said outer surfaces into longitudinally extending narrow lands slidably engaged by said flange portions of said slide.

9. Adjusting mechanism for lockable step-wise height adjustment of the backrest of a work chair having an approximately vertical support arm of rectangular cross section on which said backrest is mounted, said mechanism comprising a pair of elongate guide bars of U-shape cross section embracing opposite side edges of said support arm and affixed to said support arm, one of said guide bars having therein a series of locking recesses, a slide of C-shape cross section comprising U-shape flange portions embracing and slidable longitudinally on said guide bars and a web portion connecting said flange portions, means for mounting said backrest on said slide, a locking lever pivotally mounted on said web portion of said slide and having a nose portion engageable in said locking recesses, said locking lever being movable between a locking position in which said nose portion engages in one of said locking recesses and an unlocked position, means for biasing said locking lever to locking position and manually operable means for moving said locking lever against said bias to unlocked position.

10. Adjusting mechanism according to claim 9, in which said guide bars and said slide are extruded aluminum profiles.

* * * * *